US008701787B2

(12) United States Patent
Shkurti et al.

(10) Patent No.: US 8,701,787 B2
(45) Date of Patent: Apr. 22, 2014

(54) METAL EXPANDABLE ELEMENT BACK-UP RING FOR HIGH PRESSURE/HIGH TEMPERATURE PACKER

(75) Inventors: Piro Shkurti, The Woodlands, TX (US); John C. Wolf, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 366 days.

(21) Appl. No.: 13/036,564

(22) Filed: Feb. 28, 2011

(65) Prior Publication Data

US 2012/0217025 A1 Aug. 30, 2012

(51) Int. Cl.
*E21B 33/12* (2006.01)

(52) U.S. Cl.
USPC ..... 166/387; 166/134

(58) Field of Classification Search
USPC ..... 166/387, 196, 134
See application file for complete search history.

(56) References Cited

U.S. PATENT DOCUMENTS 3,306,362 A * 2/1967 Urbanosky ..... 277/339
4,852,394 A 8/1989 Goans
5,819,846 A * 10/1998 Bolt, Jr. ..... 166/123
6,318,461 B1 * 11/2001 Carisella ..... 166/196
6,827,150 B2 * 12/2004 Luke ..... 166/387
7,373,973 B2 * 5/2008 Smith et al. ..... 166/134
7,735,549 B1 * 6/2010 Nish et al. ..... 166/134
7,779,928 B2 * 8/2010 Turley et al. ..... 166/387
8,393,388 B2 * 3/2013 Bishop et al. ..... 166/119
2002/0070503 A1 * 6/2002 Zimmerman et al. ..... 277/337
2007/0256827 A1 * 11/2007 Guerrero et al. ..... 166/207
2007/0261863 A1 * 11/2007 Macleod et al. ..... 166/387

FOREIGN PATENT DOCUMENTS

EP 1197632 A2 * 4/2002
WO WO 2009074785 A2 * 6/2009

OTHER PUBLICATIONS

International Search Report and Written Opinion mailed on Dec. 3, 2012 for Application No. PCT/US2012/026836 filed Feb. 27, 2012 (10 pages).

* cited by examiner

*Primary Examiner* — Daniel P Stephenson
(74) *Attorney, Agent, or Firm* — Jeffery R. Peterson; Brandon S. Clark

(57) ABSTRACT

An expandable backup ring includes an outer surface, an inner surface having a plurality of protrusions projecting radially inwardly, and a plurality of segments, the segments defined by a plurality of outer surface cuts. The plurality of outer surface cuts extends radially inwardly from the outer surface and partially into each of the plurality of protrusions.

20 Claims, 14 Drawing Sheets

METAL EXPANDABLE ELEMENT BACK-UP RING FOR HIGH PRESSURE/HIGH TEMPERATURE PACKER

BACKGROUND OF INVENTION

1. Field of the Invention

Embodiments disclosed herein generally relate to a downhole isolation tool. More specifically, embodiments disclosed herein relate to a downhole isolation tool having an expandable backup ring. Additionally, embodiments disclosed herein relate to a downhole isolation system having two or more downhole isolation tools. Further, embodiments disclosed herein relate to methods of running a downhole isolation system into a well and isolating zones of a well with a downhole isolation system.

2. Background Art

In the drilling, completing, or reworking of oil wells, a great variety of downhole tools are used. For example, but not by way of limitation, it is often desirable to seal tubing or other pipe in the casing of a well, such as when it is desired to pump cement or other slurry down the tubing and force the cement or slurry around the annulus of the tubing or out into a formation. In some instances, perforations in the well in one section need to be isolated from perforations in a second section of the well. Typically, the wellbore is lined with tubular or casing to strengthen the sides of the borehole and isolate the interior of the casing from the earthen walls therearound. In order to access production fluid in a formation adjacent the wellbore, the casing is perforated, allowing the production fluid to enter the wellbore and be retrieved at the surface of the well. In other situations, there may be a need to isolate the bottom of the well from the wellhead. It then becomes necessary to seal the tubing with respect to the well casing to prevent the fluid pressure of the slurry from lifting the tubing out of the well or for otherwise isolating specific zones in which a wellbore has been placed. In other situations, there may be a need to create a pressure seal in the wellbore allowing fluid pressure to be applied to the wellbore to treat the isolated formation with pressurized fluids or solids. Downhole tools, referred to as packers and bridge plugs, are designed for the aforementioned general purposes, and are well known in the art of producing oil and gas.

Traditional packers include a sealing element having anti-extrusion rings on both upper and lower ends and a series of slips above and/or below the sealing element. Typically, a setting tool is run with the packer to set the packer. The setting may be accomplished hydraulically due to relative movement created by the setting tool when subjected to applied pressure. This relative movement causes the slips to move cones up and extend into the surrounding tubular. At the same time, the sealing element may be compressed into sealing contact with the surrounding tubular. The set may be held by a body lock ring, which may prevent reversal of the relative movement. Additionally, a packer may be run into the wellbore as part of the liner string, which would be the case with a multi zone open hole frac (or fracturing) system. In this specific case, a hydraulic setting piston is located on the packer mandrel, which may increase the pressure inside of the liner string and set all of the packers run with the liner simultaneously.

Further, due to the makeup or engagement of the backup rings adjacent the sealing element, the backup rings may provide an extrusion path for the sealing element. Extrusion of the sealing element may cause loosening of the seal against the casing wall, and may therefore cause the downhole tool to leak. Extrusion is lessened by the use of a backup ring element.

The downhole isolation tool may be run in conjunction with other downhole tools, including, for example, a sleeve coupled to a ball seat, frac plugs, bridge plugs, etc. The downhole isolation tool may be set by wireline, coil tubing, or a conventional drill string. The tool may be run in open holes, cased holes, or other downhole completion systems. The downhole isolation tool and other downhole tools may be removed by drilling through the tool and circulating fluid to the surface to remove the drilled debris.

Existing sealing element backup designs use three concepts, or a combination, to achieve containment of the element rubber during a high pressure pack-off at high temperature. The traditional designs include split rings, metal petal backup rings, and segmented backup rings.

Split ring element backup designs use two split rings with the scarf cuts opposed 180 degrees. Once the element setting pressure is applied, the rings expand radially outward and contact the casing inner diameter. Although the split section in the rings are opposed, and do not provide a continuous extrusion path, the width between the ends of the rings provide a significant volume for the element rubber to extrude into. This can decrease the rubber pressure in the element, limiting the sealing ability of the packer.

The metal petal design is a thin cup shaped ring that has been cut into petal segments on the outer diameter of the ring. When a compressive force is applied to the packer element during the setting procedure, the metal petals flex outwards and contact the casing wall. The petals trap the element rubber from extruding outwards past the clearance between the packer outer diameter and the casing inner diameter, due to the outward pressure on the petals from the element rubber and the friction between the petals and the casing inner diameter. While the overall extrusion gap has been limited by the petals, the gap between the petals created during the radial expansion becomes an extrusion gap for the element rubber. The metal petal concept can use multiple stacked metal petals to reduce the extrusion gap. Specifically, the cuts in the petal rings are offset so that there is no direct path for the rubber to extrude.

Another method used to limit sealing element extrusion is a segmented backup ring. This design uses a ring that has been cut on the outer diameter, segmenting the ring into small pieces. Usually the cuts have not been made completely through so the ring is still whole. Segmented backup rings have a tapered face and use a solid cone on the mandrel to push the segments radially outward during the setting process. When the packer setting pressure is applied, the ring is compressed against the cone. This breaks the segments into individual parts as they move to contact the casing inner diameter. Usually the segments are also guided as they expand so that the spacing between the segments will be equal. Multiple segmented rings can be offset so that no gap exists for the element rubber to extrude into. In certain applications, a combination of the metal petal and segmented ring design can be used.

The split ring backup system creates a large volume for rubber extrusion once the ring is expanded to contact the inner diameter of the casing. The extrusion path is blocked once the rubber reaches the second split ring, but this amount of initial extrusion can be a failure point since the overall volume of the rubber in the element is reduced, decreasing the rubber sealing pressure.

The metal petals are usually considered too flimsy to be used alone, two rings are usually used in tandem or combined with the segmented backup ring. The metal petal design is not considered very robust due to the ability of the petals to expand prematurely when running in the hole or during circulation before the packer is set. Additionally, the metal petal design ring may need to be fairly stiff in order to withstand the rubber pressure loads created by the packer element. This stiffness can make it difficult for the metal petals to fully conform to the casing while the setting load is applied. However, after the packer is set, and the pressure loads are applied, the rings may then fully deform to the casing. The change in volume in the sealing assembly between when the packer is set and when the pressure load is applied can cause a reduction in the total rubber pressure of the element, leading to faulty sealing.

The segmented backup ring is considered prone to segmenting prematurely when running in the hole or during circulation. It may be suitable for bridge plugs or other packers that are used in less demanding environments, but not ideal for an openhole packer or a liner top packer. The segmented backup ring is also a complicated system that requires alignment features and a secondary backup system such as the metal petal design.

Accordingly, there exists a need for an expanding downhole system that effectively minimizes extrusion of a sealing element such as a packer. Additionally, there exists a need for an expanding backup ring that may avoid premature expansion and may decrease the total amount of extrusion.

SUMMARY OF INVENTION

In one embodiment, the present invention is an expandable backup ring that includes an outer surface, an inner surface having a plurality of protrusions projecting radially inwardly, and a plurality of segments, the segments defined by a plurality of outer surface cuts. In one embodiment, the plurality of outer surface cuts extends radially inwardly from the outer surface and partially into each of the plurality of protrusions.

DETAILED DESCRIPTION

In one aspect, embodiments disclosed herein relate to an expandable ring that does not separate into distinct segments once the sealing element is set. Specifically, embodiments disclosed herein relate to an expandable ring designed to flex radially outward without breaking. This may be accomplished by thin cuts into the outer diameter of the ring, as well as corresponding cuts, which create furrows in the inner diameter of the ring offset from the outer diameter cuts. The cuts may allow for the ring to deform so that it can increase in diameter. This may provide a solid support for an inner backup ring when pressure is applied to a rubber element. The inner backup ring does not have cuts in the outer diameter so there is less or decreased possibility for rubber extrusion. A guide ring promotes consistent deformation of the expandable backup ring so that there is substantially equal spacing between each segment. This facilitates application of a consistent pressure on the rubber element and inner backup ring.

Figure 1:
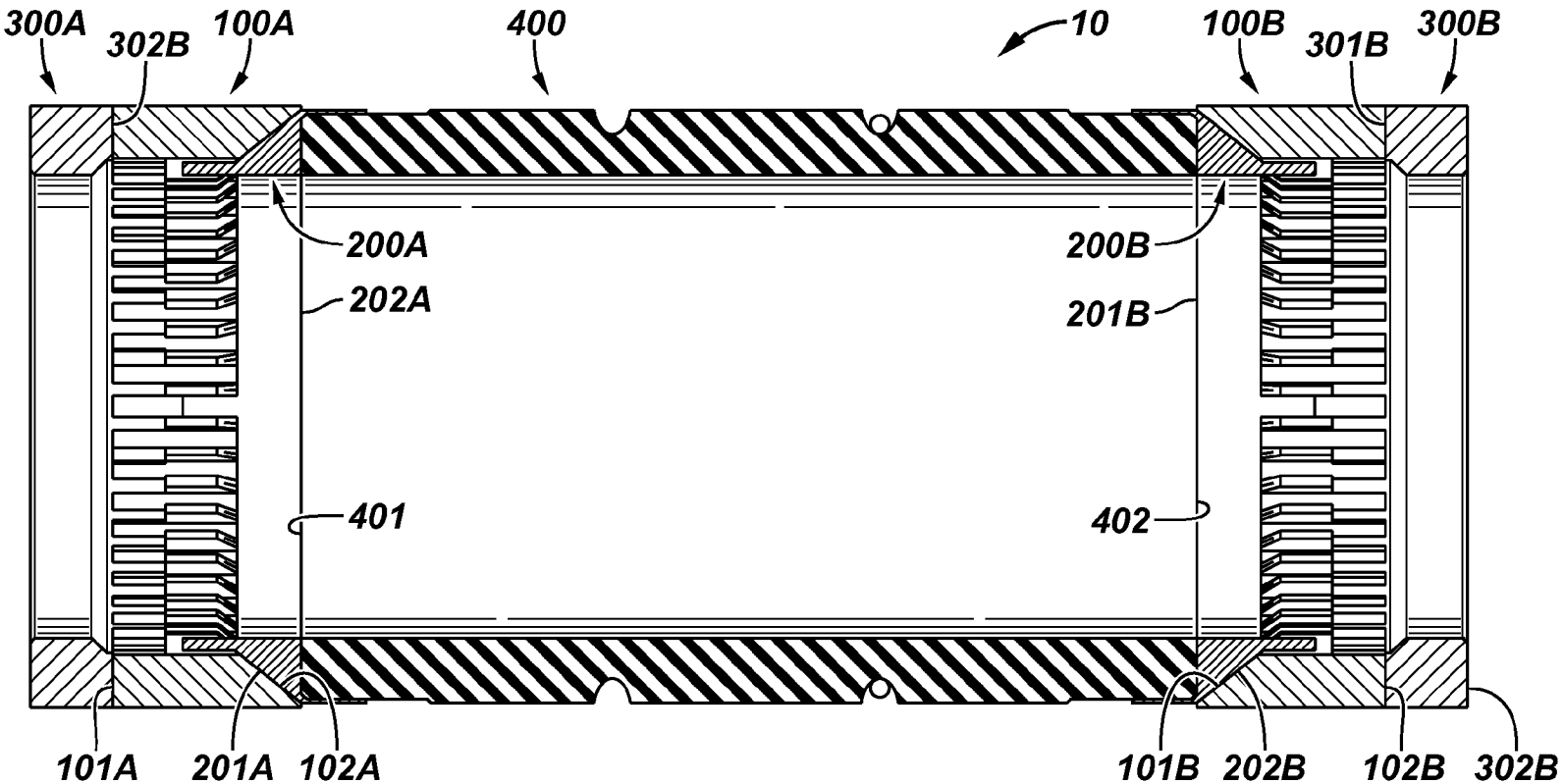
FIG. 1 is a cross-sectional side view of an expanding downhole system according to embodiments of the present disclosure.

Referring initially to FIG. 1, an expandable downhole system 10 in accordance with embodiments of the present disclosure is shown. The expandable downhole system 10 includes an upper guide ring 300A that engages an upper expandable backup ring 100A. Specifically, a bottom side 302B of the upper guide ring 300A engages a top side 101A of the upper expandable backup ring 100A. The expandable downhole system 10 also includes an upper backup ring 200A which has a top side 201A that engages a bottom side 102A of the expandable backup ring 100A. The expandable downhole system 10 further includes a packer element 400, which has a top side 401 that engages a bottom side 202A of the upper backup ring 200A. A bottom side 402 of the packer element 400 engages with a top side 201B of a lower backup ring 200B. A bottom side 202B of the lower backup ring 200B is engaged with a top side 101B of a lower expandable backup ring 100B. A bottom side 102B of the lower expandable backup ring 100B is engaged with a top side 301B of a lower guide ring 300B which also has a bottom side 302B.

In one embodiment, the backup ring, guide ring, and expandable backup ring may be formed from any material known in the art, for example, stainless steel, metal alloys, plastics, etc. The backup ring, guide ring, and expandable backup ring may also be formed from a composite material. In this embodiment, the composite material may include high-strength plastic and glass, reinforced with steel. Composite backup rings, guide rings, and expandable backup rings may provide more consistent manufacturing of the rings and may more evenly distribute mechanical stresses throughout the rings during operation.

Referring generally to FIGS. 2-5, specific geometries of a backup ring, an expandable backup ring, and a guide ring in accordance with embodiments disclosed herein are shown in perspective view.

Figure 2A:
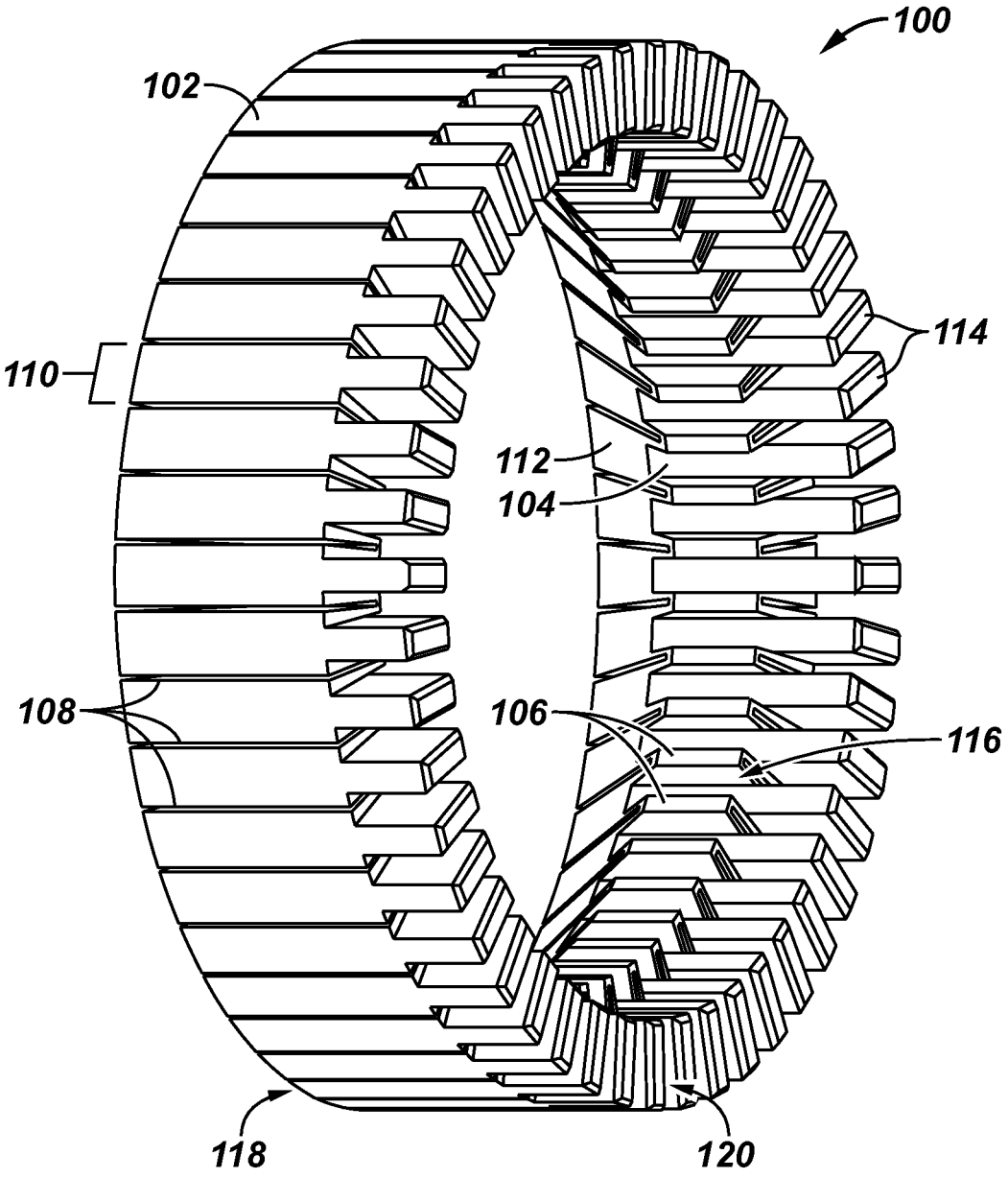
FIG. 2A is a perspective view of an expanding backup ring according to embodiments of the present disclosure.
Figure 4:
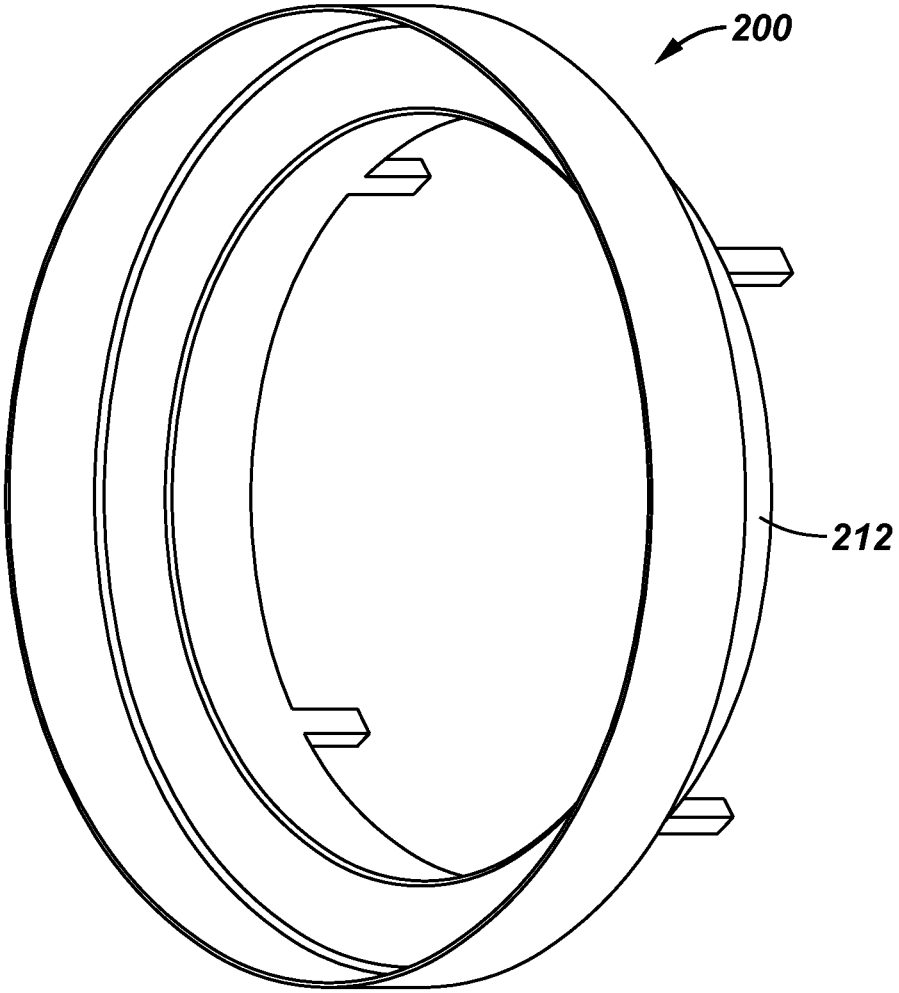
FIG. 4 is a perspective view of an inner backup ring according to embodiments of the present disclosure.

Referring now to FIG. 2A, an expandable backup ring 100 is shown that has an outer surface 102, an inner surface 104, a first end 118, and a second end 120 in accordance with embodiments disclosed herein. The inner surface 102 has a plurality of protrusions 106 projecting radially inwardly. In between each of these protrusions 106 are furrows 116. This creates a ridge and furrow pattern along the inside surface 102 of the ring 100. A plurality of outer surface cuts 108 are present along the outer surface 102. Each of the outer surface cuts 108 extend radially inwardly from the outer surface 102 and continue into each of the protrusions 106. A person of ordinary skill in the art will appreciate that the furrows 116 and the outer surface cuts 108 are radially offset from each other. This creates a radially arranged and partially corrugated pattern. Further, the outer surface cuts 108 create a plurality of segments 110, which remain connected by the protrusions 106, which protrude radially inward farther than the outer surface cuts 108 extend radially inward. A castellation 114 exists on each segment, which extends axially upwardly from the second end 120. A sloped surface 112 slopes upwardly and radially inwardly starting at the first end 118 from the outer surface 102. Sloped surface 112 is designed to engage an inner backup ring 200, as shown in FIG. 4. When the packer is engaged with sufficient force, the engagement of the sloped surface 112 with the inner backup ring 200 causes the expandable backup ring 100 to expand. Such design may then prevent extrusion of packer element 400 shown in FIGS. 1, 10, and 11.

Figure 2B:
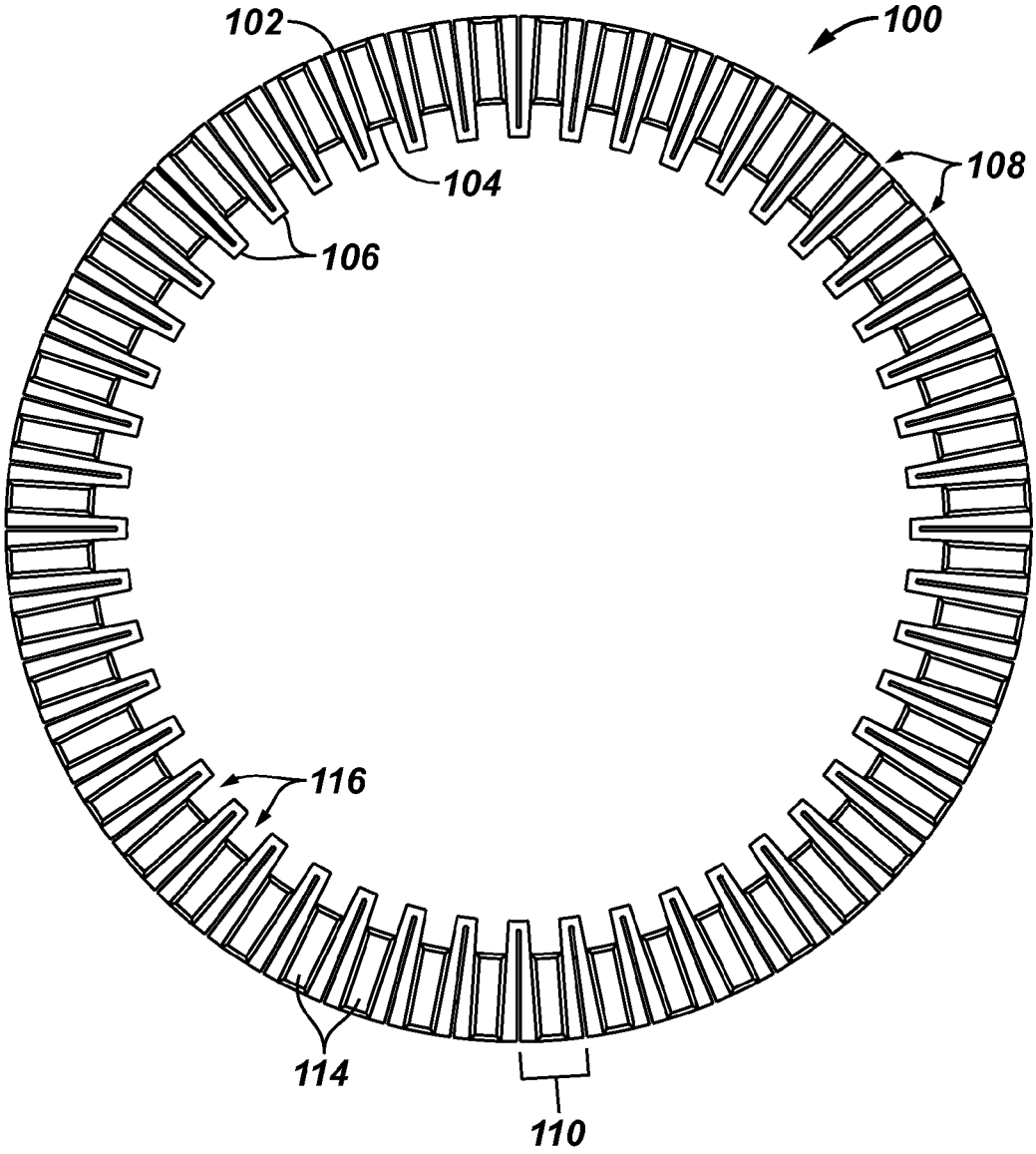
FIG. 2B is a top view of an expanding backup ring according to embodiments of the present disclosure.

Referring now to FIG. 2B, a top view of an expandable backup ring 100 in accordance with embodiments disclosed herein is shown. The outer surface 102 and the inner surface 104 are shown. These surfaces 102, 104 are shown as being cylindrical in shape. This embodiment depicts the protrusions 106 and outer surface cuts 108. It can be clearly seen that the outer surface cuts 108 extend far into protrusions 106 allowing the protrusions to remain connected at the point radially innermost. Each segment 110 contains a castellation 114, a portion of the expanding back up ring 100 located between two outer surface cuts 108, and a portion of two protrusions 106, as well as a furrow 116 between the two portions of two protrusions 106.

Figure 3A:
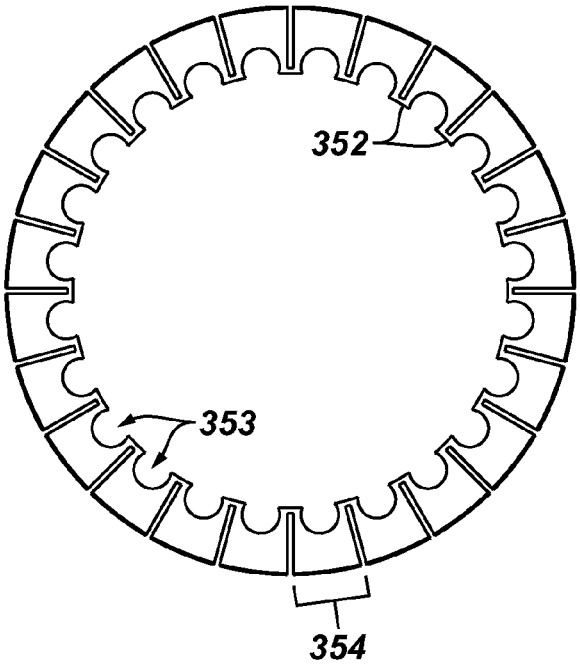
FIG. 3A is a bottom view of an expanding backup ring according to embodiments of the present disclosure.
Figure 3B:
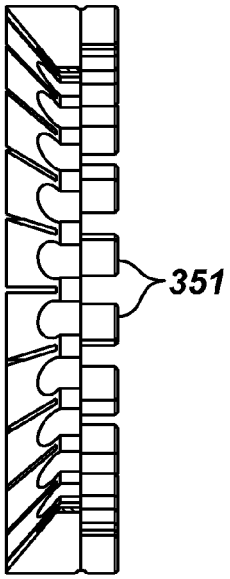
FIG. 3B is a side view of an expanding backup ring according to embodiments of the present disclosure.
Figure 3C:
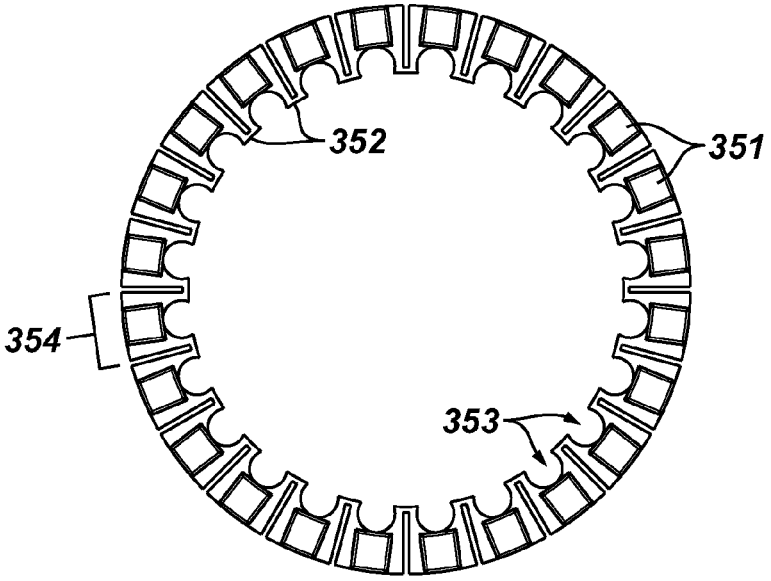
FIG. 3C is a top view of an expanding backup ring according to embodiments of the present disclosure.

Referring now to FIGS. 3A-3C, a bottom, top, and side view of an expandable backup ring in accordance with another embodiment is disclosed and shown. In this embodiment, the castellations 351 have a square-like shape. Further, the protrusions 352 are formed with curved surfaces, which create furrows 353 that are also curved. Finally, each segment 354 is generally wider as compared to the segments shown in FIG. 2B.

Figure 8:
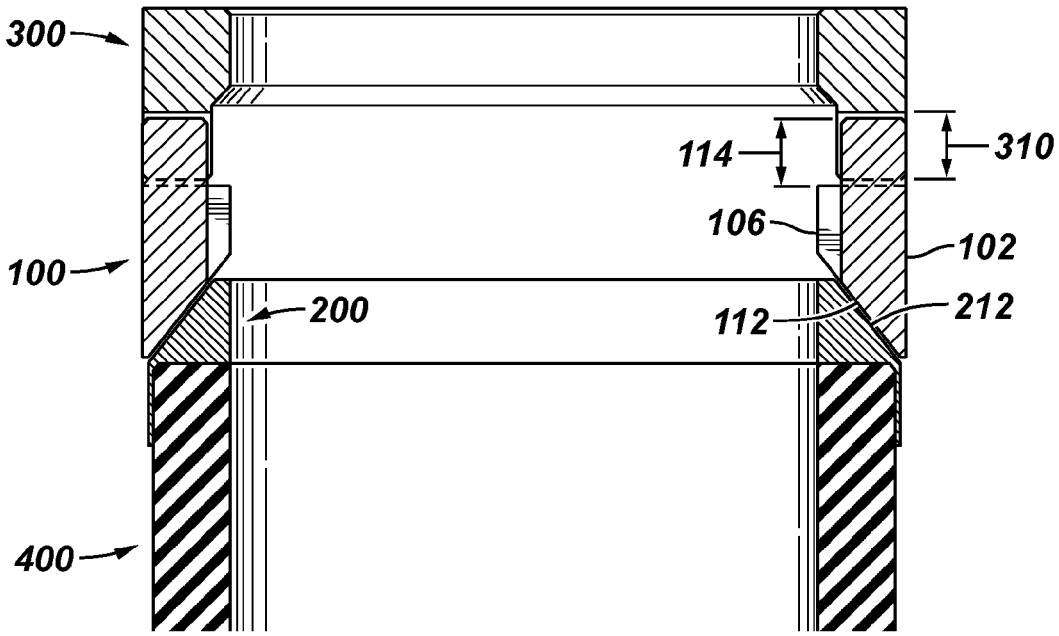
FIG. 8 is a cross-sectional view along A-A, of FIG. 6A-6C, of an unengaged expanding downhole system according to embodiments of the present disclosure.
Figure 10:
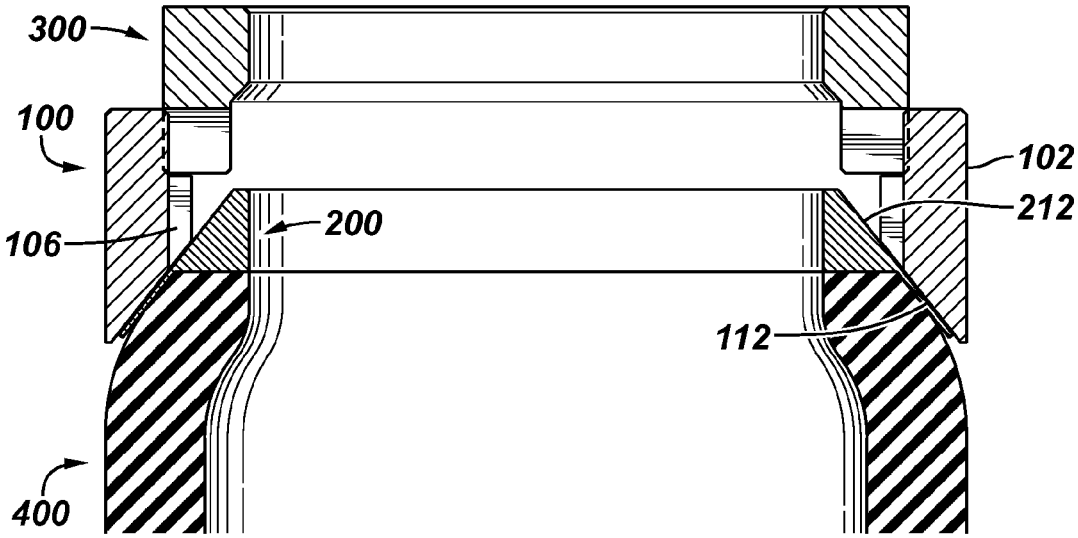
FIG. 10 is a cross-sectional view along A-A, of FIG. 6A-6C, of an engaged expanding downhole system according to embodiments of the present disclosure.

Referring now to FIG. 4, an inner backup ring 200 in accordance with embodiments disclosed herein is shown. It is important to note that the inner backup ring 200 has a slanted surface 212 which engages the sloped surface 112 of the expandable backup ring (100 of FIG. 1). As the expandable ring (100 of FIG. 1) expands the sloped surface (112 of FIG. 1) will slide along the slanted surface 212 of the inner backup ring 200 as shown in FIGS. 8 and 10.

Figure 5A:
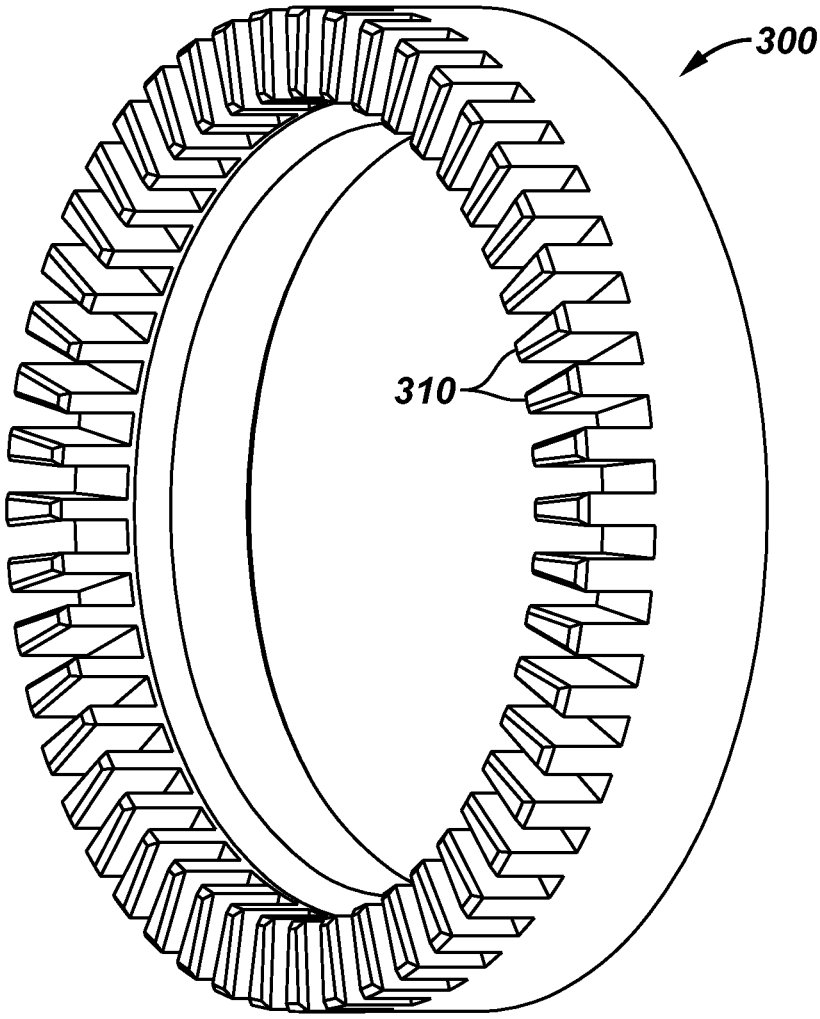
FIG. 5A is a perspective view of a guide ring according to embodiments of the present disclosure.

Referring now to FIG. 5A, a perspective view of a guide ring 300 in accordance with embodiments disclosed herein is shown. A plurality of castellations 310 extend axially downward from an end engages with the expandable backup ring (100 of FIG. 1). Specifically, the castellations 310 of the guide ring are offset such that they will fit between the castellations (114 of FIG. 2A) of the expanding backup ring (100 of FIG. 1).

Figure 5B:
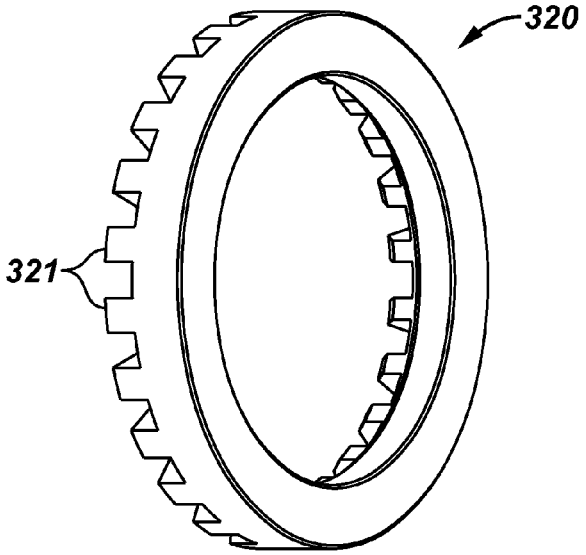
FIG. 5B is a perspective view of a guide ring according to embodiments of the present disclosure.
Figure 5C:
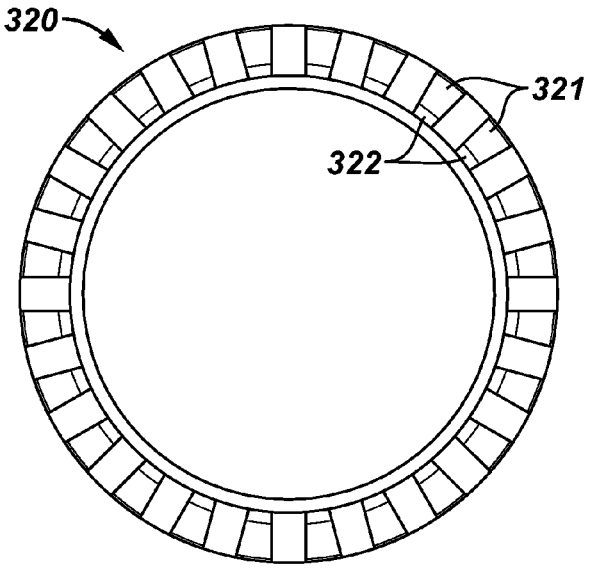
FIG. 5C is a top view of a guide ring according to embodiments of the present disclosure.
Figure 5D:
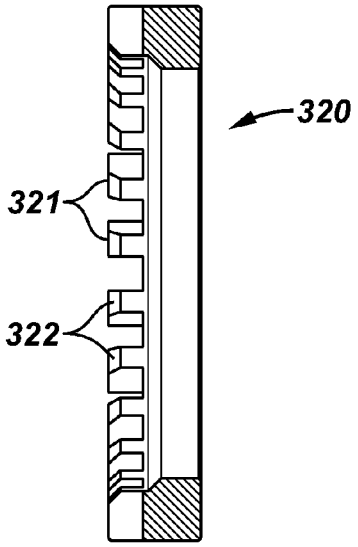
FIG. 5D is a side view of a guide ring according to embodiments of the present disclosure.

Referring now to FIGS. 5B-5C, a perspective, top, and side view of a guide ring 320 in accordance with another embodiment is disclosed and shown. In this embodiment castellations 321 have slanted inner surfaces 322. Further, the castellations 321 are relatively wider than the castellations 310 of FIG. 5A.

Figure 6A:
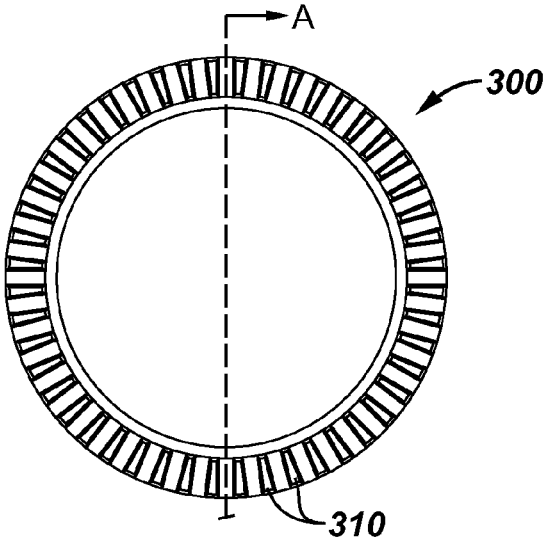
FIG. 6A is a partial top view a guide ring according to embodiments of the present disclosure.
Figure 6B:
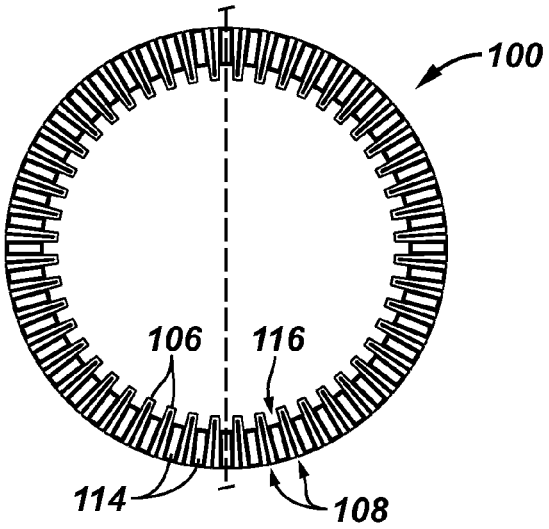
FIG. 6B is a partial top view of an expanding backup ring according to embodiments of the present disclosure.
Figure 6C:
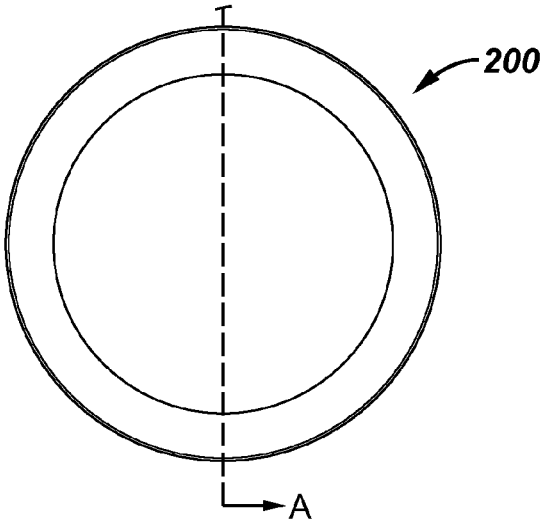
FIG. 6C is a partial top view of a inner backup ring according to embodiments of the present disclosure.

Referring now to FIGS. 6A-6C, embodiments of the rings that are comprised within an expandable downhole system are shown. Also depicted is line A-A along which cross-sectional views are shown in FIGS. 8 and 10. A guide ring 300 is shown with the plurality of castellations 310 showing such that it can be clearly seen that line A-A falls in between the castellations 310 of the guide ring 300. Further, the expandable backup ring 100 is shown in an orientation similar to FIG. 2B, so that it can be clearly seen that the line A-A cuts along a castellation 114 and furrow 116, and between two protrusions 106 and outer surface cuts 108 of the expandable backup ring 100. Thus, line A-A effectively bisects a segment 110. Given the consistent surfacing of the inner backup ring 200 it can be seen that the line A-A cuts the inner backup ring is a location that is similar to any other location of the backup ring 200.

Figure 7A:
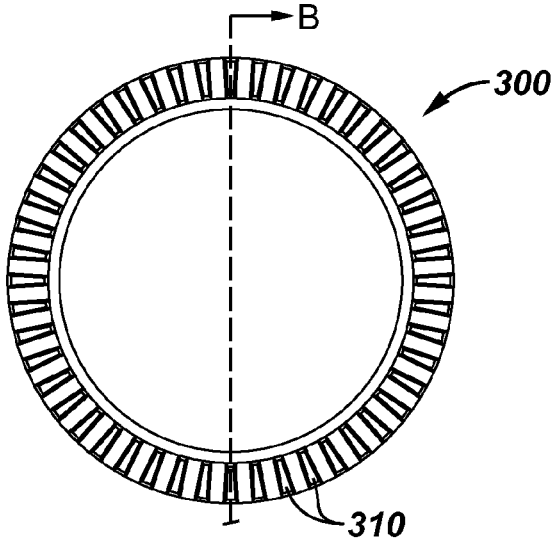
FIG. 7A is a partial top view of a guide ring according to embodiments of the present disclosure.
Figure 7B:
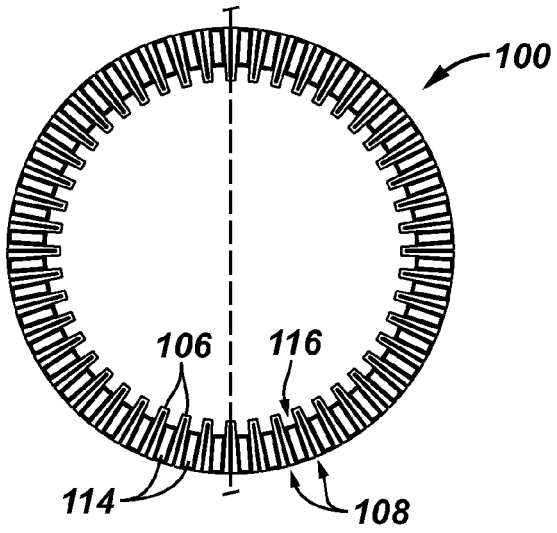
FIG. 7B is a partial top view of an expanding backup ring according to embodiments of the present disclosure.
Figure 7C:
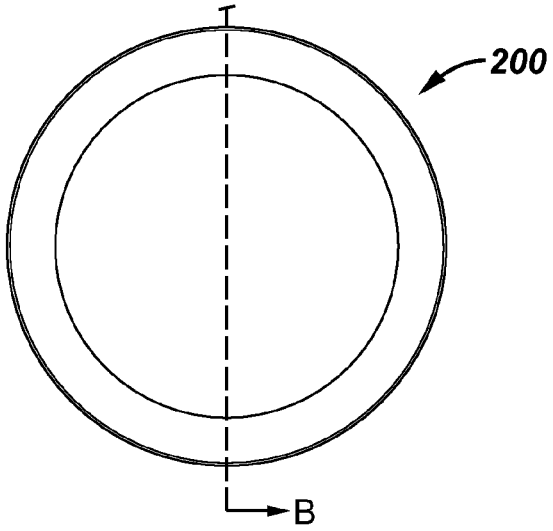
FIG. 7C is a partial top view of a inner backup ring according to embodiments of the present disclosure.
Figure 9:
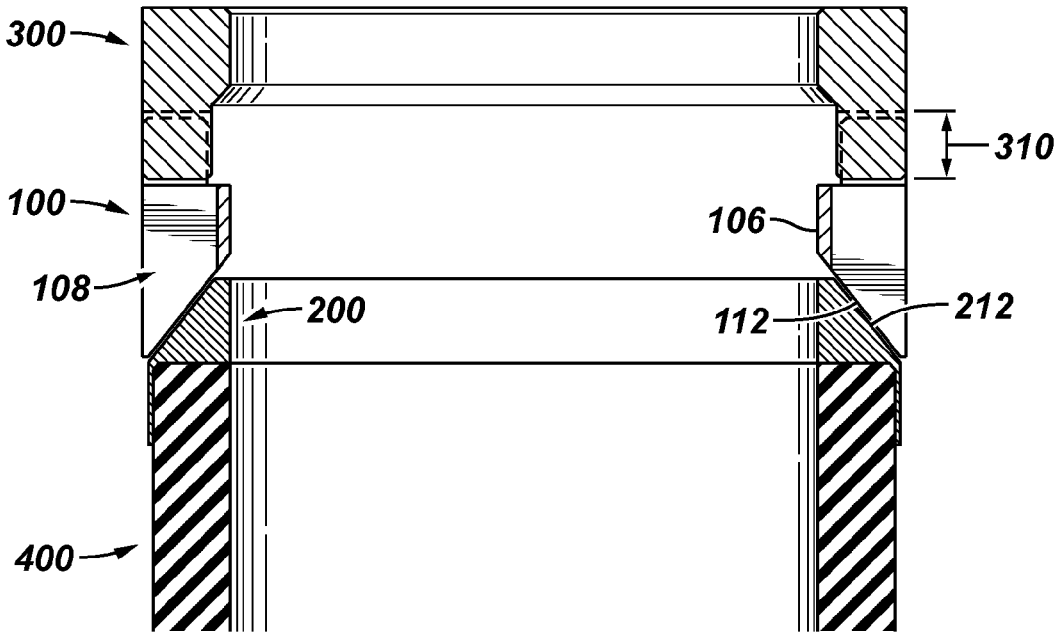
FIG. 9 is a cross-sectional view along B-B, of FIG. 7A-7C, of an unengaged expanding downhole system according to embodiments of the present disclosure.
Figure 11:
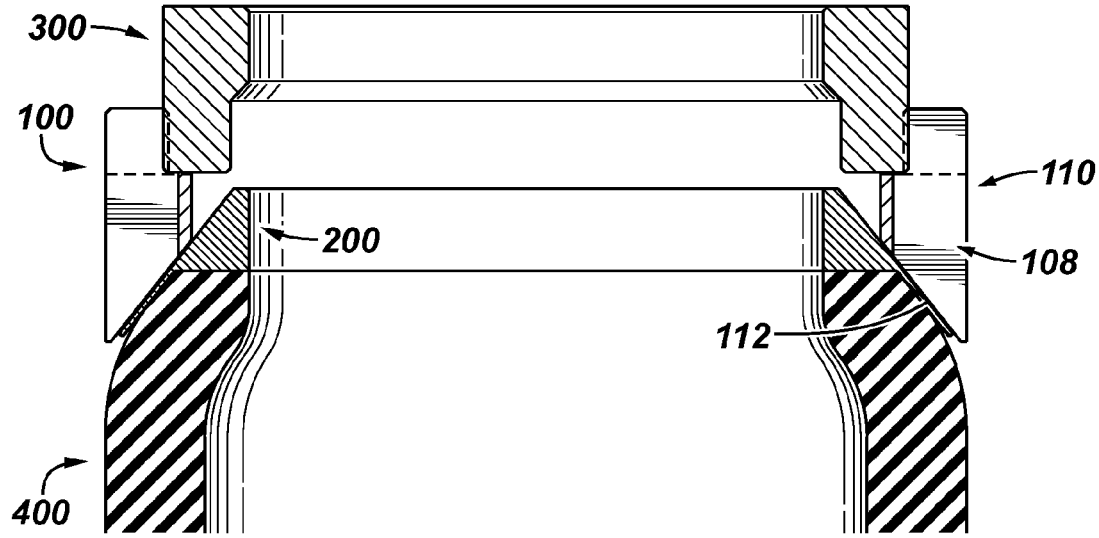
FIG. 11 is a cross-sectional view along B-B, of FIG. 7A-7C, of an engaged expanding downhole system according to embodiments of the present disclosure.

Referring now to FIG. 7A-7C, embodiments of the rings that are comprised within an expandable downhole systems in accordance with embodiments disclosed herein is shown. Also depicted is line B-B along which cross-sectional views are shown in FIGS. 9 and 11. The guide ring 300 is shown with the plurality of castellations 310 showing such that it can be clearly seen that line B-B falls along one of the castellations 310 of the guide ring 300. Further, the expandable backup ring 100 is shown in an orientation similar to FIG. 2B so that it can be clearly seen that the line B-B cuts between two castellation 114 and furrows 116 and along a protrusion 106 and outer surface cut 108 of the expandable backup ring 100. Thus, line B-B effectively cuts the expandable backup ring 100 into segments 110. Given the consistent surfacing of the inner backup ring 200 it can be seen that the line B-B also cuts the inner backup ring is a location that is similar to any other location of the backup ring 200 as was the case with A-A as well.

Referring to FIGS. 8 and 9, cross-sectional views of an expandable downhole system in accordance with embodiments disclosed herein are shown wherein the expandable backup ring 100 has not been expanded. Referring to FIGS. 10 and 11, cross-sectional views of an expandable downhole system in accordance with embodiments disclosed herein are shown wherein the expandable backup ring 100 has been expanded.

Referring to FIG. 8, a guide ring 300, an expandable backup ring 100, a backup ring 200, and a portion of a packer element 400 are shown in accordance with embodiments disclosed herein in a non-expanded position. This cross-sectional view of FIG. 8, along line A-A shown in FIGS. 6A-6C, shows how the three rings 100, 200, 300 and the packer element 400 fit together when the expandable backup ring 100 is not expanded. As shown, the castellations 114 of the expandable backup ring 100 and the castellations 310 of the guide ring 300 fit together in an alternating pattern such that when cut along A-A only the castellation 114 of the expandable backup ring 100 is cut in the cross-sectional view while the castellation 310 of the guide ring 300 is only seen in FIG. 8 in the background. Comparing FIG. 8 with FIG. 9, it can be seen that when cut along B-B only the castellation 310 of the guide ring 300 is visible. In the cross-sectional view cut along B-B shown in FIG. 9 it is noted that the castellations 310 do not allow the castellations 114 of the expandable backup ring to be visible in the background because in this embodiment the castellations 310 of the guide ring 300 are wider. In another embodiment of the present disclosure the width of the castellations of both rings may be equal. In a further embodiment of the present disclosure it is also possible that the castellations 114 of the expandable backup ring 100 are wider than the castellations 310 of the guide ring.

Further, in FIG. 8 the backup ring 200 engages the sloped surface 112 of the expandable backup ring 100. In this embodiment shown in FIG. 8, the sloped surfaces of both rings are of equal length. In another embodiment of the invention the sloped surface 112 of the expandable backup ring 100 may be longer than the slanted surface of the backup ring 200. In a further embodiment of the invention the sloped surface 112 of the expandable backup ring 100 may be shorter than the slanted surface of the backup ring 200.

Finally, in FIG. 8 the backup ring 100 is shown engaging the packer element 400 opposite the surface which engages the expandable backup ring 100. In this embodiment shown in FIG. 8 it is shown to consist of two flat surfaces which are perpendicular to the wellbore in which the entire downhole expandable system is located. In another embodiment of the invention this surface may also be sloped. In a further embodiment of the invention the surfaces of the packer element 400 and the backup ring 200 may be different lengths. For example, the backup ring 200 may have a wider contacting surface with the packer element 400 which may then provide more support and guidance when the packer element 400 begins to deform as it engages under pressure.

Referring now to FIG. 9, this cross-sectional view, along line B-B shown in FIGS. 7A-7C, illustrates how outer surface cuts 108 affect the contact surfaces with both the guide ring 300 and the backup ring 200 in accordance with embodiments disclosed herein. Where the outer surface cut 108 exists, there is no contact with either the guide ring 300 or the backup ring 200. This cross-sectional view shows that there is a connection in the expandable backup ring 100 where the outer surface cuts 108 end and the protrusions 106 continue radially inwardly. This provides a portion of the protrusions 106 of the expandable backup ring 100 which is cut through in this cross-sectional view. These connecting portions of the protrusions 106 of the expandable backup ring 100 allow the expandable backup ring 100 to remain connected as it expands outwardly as shown in FIGS. 10 and 11. In another embodiment, these connecting portions of the protrusions 106 may be larger or smaller. For example, these connecting portions of the protrusions 106 may be made larger so that there is contact between the three rings along this cross-sectional view when the expandable backup ring is not expanded. This could be accomplished by ending the outer surface cuts 108, which extend from the outer surface 102 radially inwardly, earlier. Another embodiment may include a connecting portion of the protrusions 106 that is smaller than what is depicted in FIGS. 9 and 11. This may be accomplished by extending the outer surface cuts 108 farther radially inwardly.

Referring to FIG. 10, a guide ring 300, an expandable backup ring 100, a backup ring 200, and a portion of a packer element 400 are shown in accordance with embodiments disclosed herein in an expanded position. Specifically, a cross-sectional view along line A-A as depicted in FIGS. 6A-6C is shown. In this expanded position the expandable backup ring 100 has expanded and has slid diagonally down and out along the slanted surface of the backup ring 200. Thus, the guide ring 300 has also moved downward, but did not expand outward. Further, in the expanded state it can be seen that the packer element 400 has also expanded outwardly. The backup ring 200, which remains in place, provides a surface against which the warping packer element 400 can make contact with and avoid extrusion. Further, by having the expandable backup ring 100 expand and move both outward and downward, the space that was previously open is now filled by the expandable backup ring 100. This helps prevent extrusion of the packer element 400. Further, because the expandable backup ring 100 remains in a single piece, it may avoid premature expansion and provides a more stable extrusion preventing seal in the area it occupies once it is expanded.

Referring to FIG. 11, a guide ring 300, an expandable backup ring 100, a backup ring 200, and a portion of a packer element 400 are shown in accordance with embodiments disclosed herein in an expanded position. Specifically, a cross-sectional view along line B-B as depicted in FIGS. 7A-7C is shown. In this embodiment, it can be seen that the space created by the outer surface cuts 108 provide an area where no contact occurs. In one embodiment of the invention these outer surface cuts 108 are machined as thinly as possible in order to maximize the surface area of the sloped surface 112 of the expandable backup ring 100 to further limit the extrusion of the packer element 400.

Figure 12:
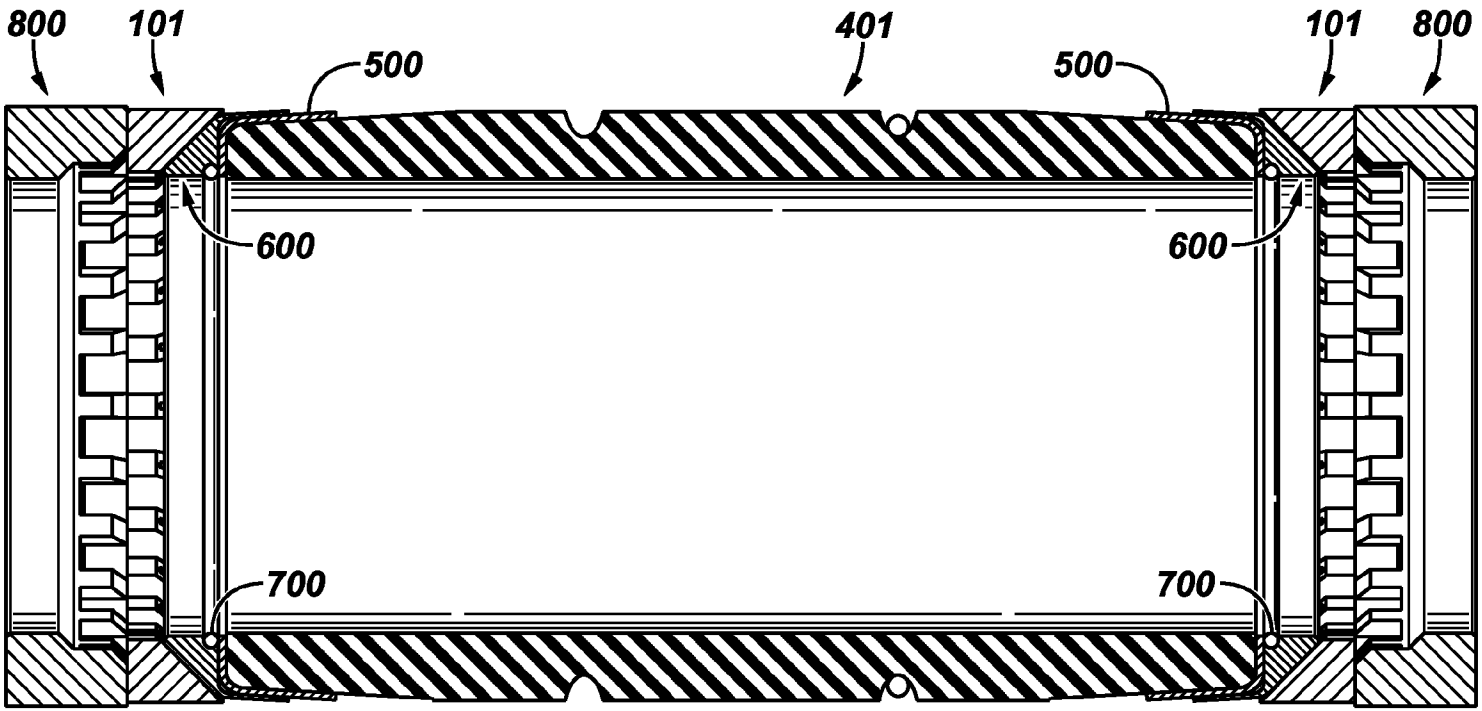
FIG. 12 is a cross-sectional side view of an expanding downhole system according to embodiments of the present disclosure.

Referring to FIG. 12, an expanding downhole system, which includes a packer element 401, an activation support ring 500, a bather ring 600, an expandable backup ring 101, a mandrel seal ring 700, and a gauge ring 800, is shown in accordance with embodiments disclosed herein. In this embodiment, there are fewer segments cut into the expandable backup ring 101. This may have the benefit of reducing cost for applications with lower differential pressure. The mandrel seal ring 700 has been added in order to prevent rubber extrusion under the bather ring 600 during high differential pressures. Also, an activation support ring 500 located under the bather ring 600 is present in this embodiment. The activation support ring 500 allows for consistent activation of the expandable downhole system and insures that the expandable downhole system fully deforms against the sealing bore, leaving no volume for element extrusion.

Figure 13:
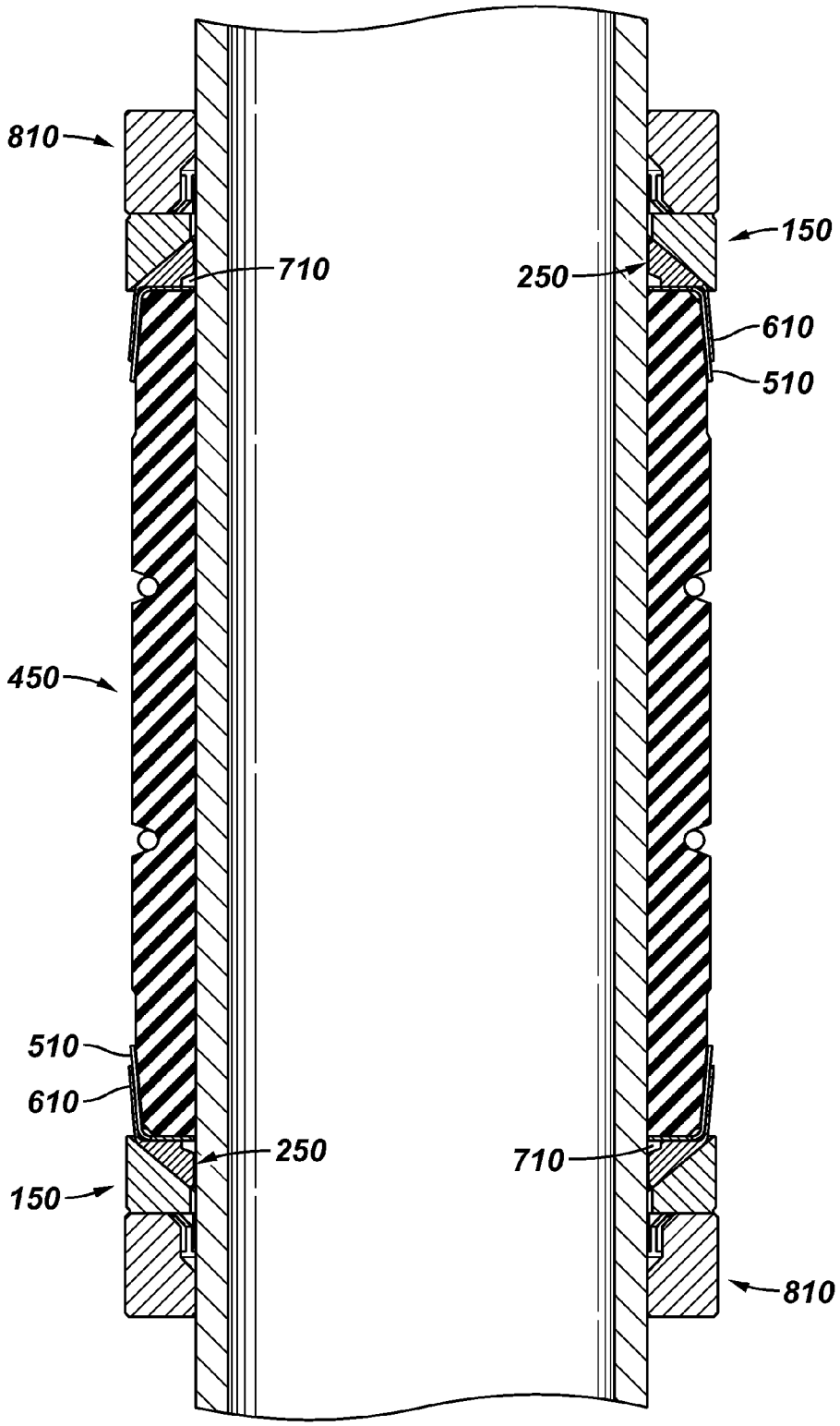
FIG. 13 is a cross-sectional view of an unengaged expanding downhole system according to embodiments of the present disclosure.
Figure 14:
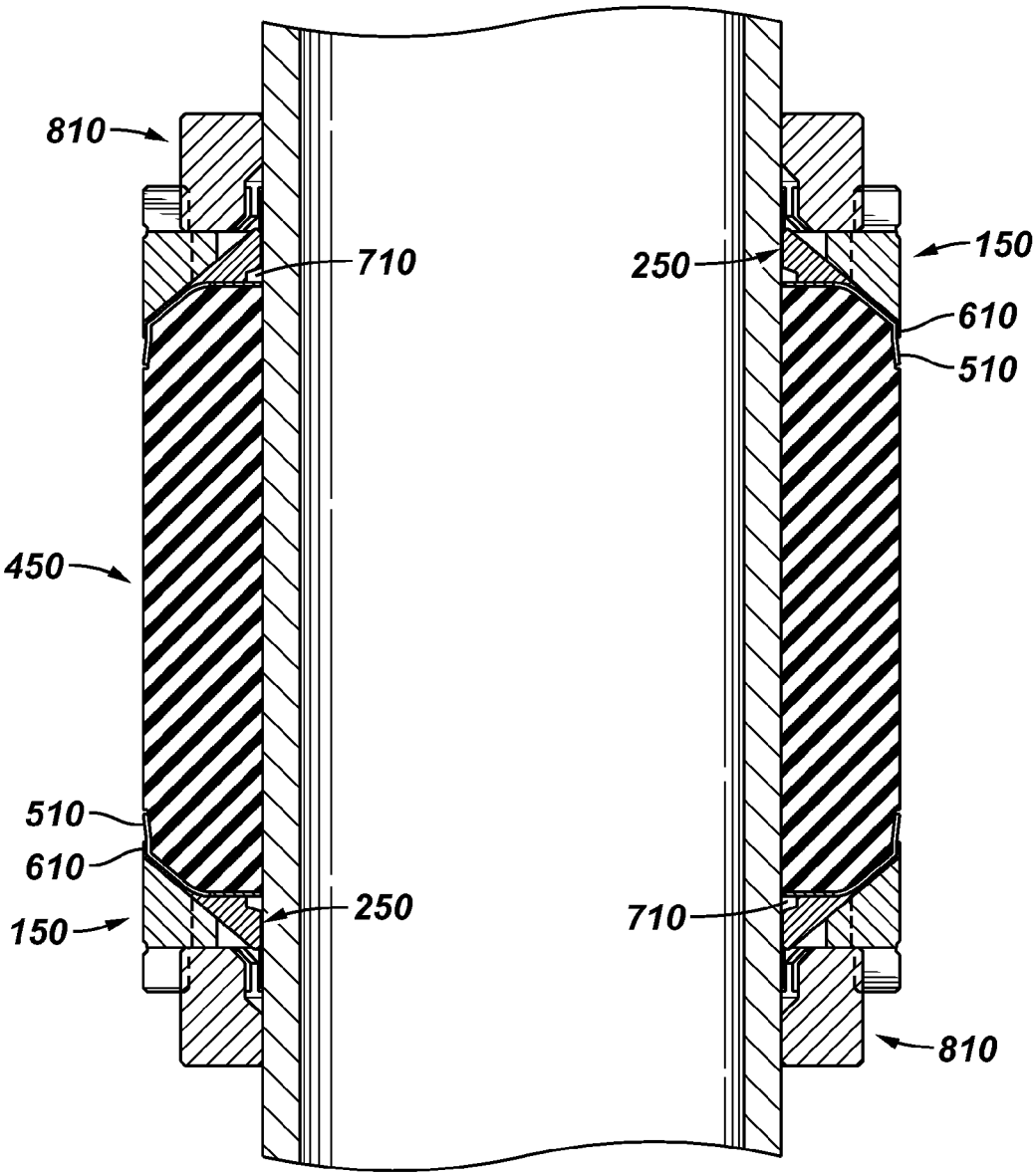
FIG. 14 is a cross-sectional view of an engaged expanding downhole system according to embodiments of the present disclosure.

Referring to FIG. 13, an unengaged expanding downhole system, which includes a packer element 450, an activation support ring 510, a barrier ring 610, an expandable backup ring 150, a mandrel seal ring 710, a gauge ring 810, and a backup ring 250, is shown in accordance with another embodiment. Referring to FIG. 14, an engaged and expanded downhole system, which includes a packer element 450, an activation support ring 510, a barrier ring 610, an expandable backup ring 150, a mandrel seal ring 710, a gauge ring 810, and a backup ring 250, is shown in accordance with the another embodiment disclosed.

Advantageously, embodiments disclosed herein may provide the benefit of a design that is robust enough to be used for an openhole packer or a liner top packer. Embodiments disclosed herein may also provide the benefit of a design that creates the complete containment of the rubber and zero extrusion gap once the expandable sealing element is set. This is beneficial for applications such as the openhole packer, where once the element is set it may not be aided by boosting due to a pressure reversal. A further benefit of one or more of the above embodiments may be that the inner backup ring is not segmented, which increases the ability of the inner back up ring to withstand high circulation rates and running into debris while tripping the packer in the hole.

While embodiments have been described with respect to a limited number of embodiments, those skilled in the art, having benefit of this disclosure, will appreciate that other embodiments can be devised which do not depart from the scope of embodiments disclosed herein. Accordingly, the scope of embodiments disclosed herein should be limited only by the attached claims.

What is claimed is:

1. An expandable backup ring comprising:

an outer surface;

an inner surface having a plurality of protrusions projecting radially inwardly; and a plurality of segments, the segments defined by a plurality of outer surface cuts, wherein each sequential pair of outer cuts defines a segment, wherein the plurality of outer surface cuts extends radially inwardly from the outer surface and partially into each of the plurality of protrusions.

2. The expandable backup ring of claim 1, wherein the inner surface further comprises:

a sloped surface that slopes upwardly and radially inwardly starting at a first end of the outer surface.

3. The expandable backup ring of claim 1, wherein a second end of the expandable backup ring comprises a plurality of castellations extending axially upwardly.

4. The expandable backup ring of claim 3, wherein each of the plurality of axially upwardly extending castellations project from one of the plurality of segments.

5. The expandable backup ring of claim 1, wherein a plurality of inner surface furrows extend between the plurality of protrusions.

6. The expandable backup ring of claim 5, wherein the plurality of inner surface furrows are radially offset from the plurality of outer surface cuts.

7. The expandable backup ring of claim 1, wherein the expandable backup ring is formed from a metallic material.

8. The expandable backup ring of claim 1, wherein the expandable backup ring is formed from one selected from a group consisting of stainless steel, metal alloys, plastics, and composite material.

9. The expandable backup ring of claim 1, wherein the expandable backup ring is configured to expand radially outwardly, and wherein the plurality of outer surface cuts are configured to widen in response to an outwardly directed force.

10. A expandable downhole system comprising:

a packer element having an upper end and a lower end;

an upper backup ring disposed adjacent the upper end of the packer element;

an upper expandable backup ring configured to engage the upper backup ring, wherein the upper expandable backup ring comprises:

an outer surface;

an inner surface having a plurality of protrusions projecting radially inwardly; and a plurality of segments, the segments defined by a plurality of outer surface cuts, wherein each sequential pair of outer surface cuts defines one segment, wherein the plurality of outer surface cuts extends radially inwardly from the outer surface and partially into each of the plurality of protrusions; and an upper guide ring configured to engage the upper expandable backup ring.

11. The expandable downhole system of claim 10, wherein the upper expandable backup ring further comprises a first surface having a plurality of castellations extending axially upwardly from the plurality of segments.

12. The expandable downhole system of claim 11 further comprising:

a corresponding set of castellations disposed on a downward-facing surface of the upper guide ring, and wherein the castellations disposed on the upper expandable backup ring are configured to engage a corresponding set of castellations disposed on a downward-facing surface of the upper guide ring.

13. The expandable downhole system of claim 12, wherein the castellations disposed on the upper expandable backup ring are radially movable with respect to the corresponding set of castellations disposed on the downward-facing surface of the upper guide ring.

14. The expandable downhole system of claim 10 further comprising:

a lower backup ring disposed adjacent the lower end of the packer element;

a lower expandable backup ring configured to engage the lower backup ring, wherein the lower expandable backup ring comprises:

an outer surface;

an inner surface having a plurality of protrusions projecting radially inwardly; and a plurality of segments, the segments defined by a plurality of outer surface cuts, wherein the plurality of outer surface cuts extends radially inwardly from the outer surface and partially into each of the plurality of protrusions; and a lower guide ring configured to engage the lower expandable backup ring.

15. The expandable downhole system of claim 14, wherein the lower expandable backup ring further comprises a second surface having a plurality of castellations extending axially downwardly from the plurality of segments, wherein the castellations disposed on the lower expandable backup ring are configured to engage a corresponding set of castellations disposed on an upward-facing surface of the lower guide ring, and wherein the castellations disposed on the lower expandable backup ring are radially movable with respect to the corresponding set of castellations disposed on the upward facing surface of the lower guide ring.

16. A method of setting an expandable downhole system, the method comprising:

positioning the expandable downhole system in a wellbore, the expandable downhole system comprising:

a packer element having an upper end and a lower end;

an upper backup ring disposed adjacent the upper end of the packer element, and a lower backup ring disposed adjacent the lower end of the packer element;

an upper expandable backup ring configured to engage the upper backup ring, and a lower expandable backup ring configured to engage the lower backup ring, wherein the upper expandable backup ring and the lower expandable backup ring each comprise:

an outer surface;

an inner surface having a plurality of protrusions projecting radially inwardly; and a plurality of segments, the segments defined by a plurality of outer surface cuts, wherein each sequential pair of the outer surface cuts defines one segment, wherein the plurality of outer surface cuts extends radially inwardly from the outer surface and partially into each of the plurality of protrusions; and an upper guide ring configured to engage the upper expandable backup ring and a lower guide ring configured to engage the lower expandable backup ring;

applying an axially compressive force against the expandable downhole system;

radially expanding the packer element; and radially expanding the upper expandable backup ring and the lower expandable backup ring.

17. The method of claim 16, wherein radially expanding the upper expandable backup ring and the lower expandable backup ring comprises:

deforming the upper expandable backup ring at a first deformation region adjacent the plurality of outer surface cuts disposed on the upper expandable backup ring; and deforming the lower expandable backup ring at a second deformation region adjacent the plurality of outer surface cuts disposed on the lower expandable backup ring.

18. The method of claim 17, wherein the deforming the upper expandable backup ring and the deforming the lower expandable backup ring comprises plastically deforming the upper and lower expandable backup rings.

19. The method of claim 16, wherein the upper expandable backup ring comprises an upwardly facing surface having a plurality of castellations disposed thereon configured to engage a corresponding set of castellations disposed on the upper guide ring, and wherein the lower expandable backup ring comprises a downwardly facing surface having a plurality of castellations disposed thereon configured to engage a corresponding set of castellations disposed on the lower guide ring.

20. The method of claim 19, wherein the radially expanding the upper expandable backup ring and the lower expandable backup ring further comprises:

moving the plurality of castellations disposed on the upwardly facing surface of the upper expandable backup ring radially outwardly with respect to the corresponding set of castellations disposed on the upper guide ring; and moving the plurality of castellations disposed on the downwardly facing surface of the lower expandable backup ring radially outwardly with respect to the corresponding set of castellations disposed on the lower guide ring.

* * * * *